US006971213B2

(12) United States Patent
Battisti

(10) Patent No.: US 6,971,213 B2
(45) Date of Patent: Dec. 6, 2005

(54) METHOD FOR THE SEPARATE REJECTION OF DEFECTIVE ITEMS, IN PARTICULAR STRIP PACKAGES, DURING TRANSFERRING FROM A PACKAGING LINE TO A CONVEYING LINE

(75) Inventor: Antonio Battisti, Latina (IT)

(73) Assignee: Packservice, S.r.l., Latina (IT)

( * ) Notice: Subject to any disclaimer, the term of this patent is extended or adjusted under 35 U.S.C. 154(b) by 0 days.

(21) Appl. No.: 10/407,109

(22) Filed: Apr. 4, 2003

(65) Prior Publication Data

US 2003/0188513 A1 Oct. 9, 2003

(30) Foreign Application Priority Data

Apr. 8, 2002 (IT) ..... BO2002A0180

(51) Int. Cl.[7] ..... B65B 57/14
(52) U.S. Cl. ..... 53/53; 53/54
(58) Field of Search ..... 53/411, 53, 54, 53/498, 505; 198/418.5

(56) References Cited

U.S. PATENT DOCUMENTS 3,874,144 A * 4/1975 Feigel ..... 53/53
3,882,316 A * 5/1975 Garris ..... 250/559.15
4,012,888 A * 3/1977 Nichols ..... 53/131.3
4,472,922 A * 9/1984 Romagnoli ..... 53/53
5,019,326 A * 5/1991 Yaginuma et al. ..... 376/261
5,040,353 A * 8/1991 Evans et al. ..... 53/54
5,081,816 A * 1/1992 Cardinali ..... 53/54
5,363,968 A * 11/1994 Soloman ..... 209/546
5,542,235 A * 8/1996 Konstandin ..... 53/454
5,565,059 A * 10/1996 Edwards et al. ..... 156/517
5,622,025 A * 4/1997 Kitagawa et al. ..... 53/53
5,802,803 A * 9/1998 Kitagawa et al. ..... 53/54
5,881,532 A * 3/1999 Kitagawa ..... 53/54
6,010,462 A * 1/2000 Stoermer, III ..... 600/572
6,061,996 A * 5/2000 Vissers et al. ..... 53/244
6,070,385 A * 6/2000 Antonio ..... 53/53
6,385,947 B2 * 5/2002 Meis ..... 53/444
6,571,537 B2 * 6/2003 Ghirlandi ..... 53/413
2003/0085102 A1 * 5/2003 Monti
2004/0094050 A1 * 5/2004 Ackley et al. ..... 101/44

* cited by examiner

*Primary Examiner*—Scott A. Smith
*Assistant Examiner*—Gloria R. Weeks
(74) *Attorney, Agent, or Firm*—William J. Sapone; Henry Coleman; R. Neil Sudol

(57) ABSTRACT

A method for the rejection of single defective items, in particular strip packages, during transferring from a packaging line to a conveying line, includes a preliminary check of the integrity of each product present on the packaging line and the subsequent removable gripping of each tested product by transfer device. The transfer device moves the products away from the packaging line and release the defective-tested products at a first collection section or at a second collection section, while each integral-tested product is released onto the conveying line.

12 Claims, 4 Drawing Sheets

METHOD FOR THE SEPARATE REJECTION OF DEFECTIVE ITEMS, IN PARTICULAR STRIP PACKAGES, DURING TRANSFERRING FROM A PACKAGING LINE TO A CONVEYING LINE

BACKGROUND OF THE INVENTION

The present invention refers to the technical field relating to the automatic packaging of items, in particular tablets, pills, capsules and similar products.

In the specific case, the present invention proposes a method for the single rejection of defective items, in particular strip packages, during the transfer step from a packaging line to a conveying line.

DESCRIPTION OF THE PRIOR ART

Strip packaging, especially suitable for effervescent products, which are considerably sensitive to humidity, and in general for pharmaceutical products, allows hermetically sealing each product, providing information on the product contained in the package printed and/or coded onto the same.

It is widely known that strip packages are obtained from two sheets of a heat-sealable material, superimposed in contact with one another, which form a plurality of pockets, suitably heat-sealed in the proximity of the peripheral edges, evenly spaced and containing single products.

Pre-cuts are made at the heat-sealed regions comprised between adjacent pockets, belonging to the same longitudinal row or to an adjacent row, which form pre-breaking portions that facilitate the separation of the single pocket from the package.

According to the requirements, strip packages can consist of a single pocket containing the respective product, or a plurality of pockets, generally arranged on one or more longitudinal rows.

The machines according to the prior art, capable of producing strips of packaged items, extend substantially in a vertical direction and are operated according to a continuous operation cycle.

In the upper part of these machines, there is a feeding station which feeds products to a packaging station situated below in cascade, where the products are introduced and sealed into the respective pockets.

Downstream of such packaging station there is an operating station which, according to a continuous operating cycle, performs the following steps in a sequence: printing information, for example by ink jet, on each pocket; checking, by suitable feeler means, the presence of products into each sealed pocket; coding by dry stamping; cross pre-cutting relative to the direction of forward movement of the heat-sealed pockets band, performed by pre-breaking units; longitudinal cut of each longitudinal row by first cutting units; cross cutting of each longitudinal row by second cutting units.

The strip packages thus obtained, consisting of a predetermined number of pockets, after the cross cutting, are conveyed by chute conveyors which, by the effect of gravity, are capable of spacing and addressing them towards belt conveyors provided nearby.

According to the signals transmitted by the feeler means, in suitable phase relation with them, suitable selecting means alternately address the strip packages onto the belt conveyors, if positively tested, or into suitable recovery stations, if negatively tested, adapted for collecting defective strip packages.

Defective strip packages can lack one or more products, or can contain not entire, i.e. broken products, inside the corresponding pockets.

One of the major disadvantages of such packaging machines is undoubtedly the necessity to use an additional machine, placed in cascade with respect to the described one, which allows feeding of a packaging machine capable of introducing so obtained strip packs into boxes, generally of cardboard.

Such problem was solved by the machine disclosed in document no. B02002A 000034 by the same Applicant.

A further disadvantage of conventional strip packaging machines is the necessity to reject the entire cross row of strip packages by the selecting means if anomalies are detected by the feeler means.

This necessarily implies the rejection of positively tested strip packages in the same cross row along with abnormal strip packages (due to the lack of one or more products into the relative seats), with a resulting loss of productivity in the processing cycle.

SUMMARY OF THE INVENTION

The object of the present invention is that of solving the above mentioned disadvantages by proposing a method for rejecting defective items, in particular strip packages, during transferring from a packaging line to a conveying line, capable of selectively and individually rejecting the defective items only.

A further object of the present invention is that of proposing a method characterized by especially simple and reliable operating steps, which allows a separate rejection of items based on the type of defect.

A further object of the present invention is that of proposing a method capable of carrying out the rejection of defective items with a variable size within a wide range.

The above mentioned objects are obtained, in accordance with the contents of the claims, by a method for the single rejection of defective items, in particular single strip packages, during transferring from a packaging line to a conveying line, the items being moved on said packaging line by driving means, the method including the following operation steps:

- checking the integrity of each product present on said packaging line by corresponding feeler means associated to said packaging line;
- removably gripping every tested strip package by transfer means provided at the end of the packaging line and arranged so as to determine a pick-up position;
- operating said transfer means for moving said products away from said packaging line;
- releasing, by said transfer means, at least one of defective-tested products in at least one first collection section, situated near said packaging line, in step relation with the motion of the transfer means;
- positioning of each entire-tested strip package onto the conveying line with the transfer means situated in a release position.

BRIEF DESCRIPTION OF THE DRAWINGS

The invention will now be described in more detail with reference to particular, non-limiting embodiments and with reference to the accompanying drawings, in which.

DISCLOSURE OF THE PREFERRED EMBODIMENT

Figure 1A:
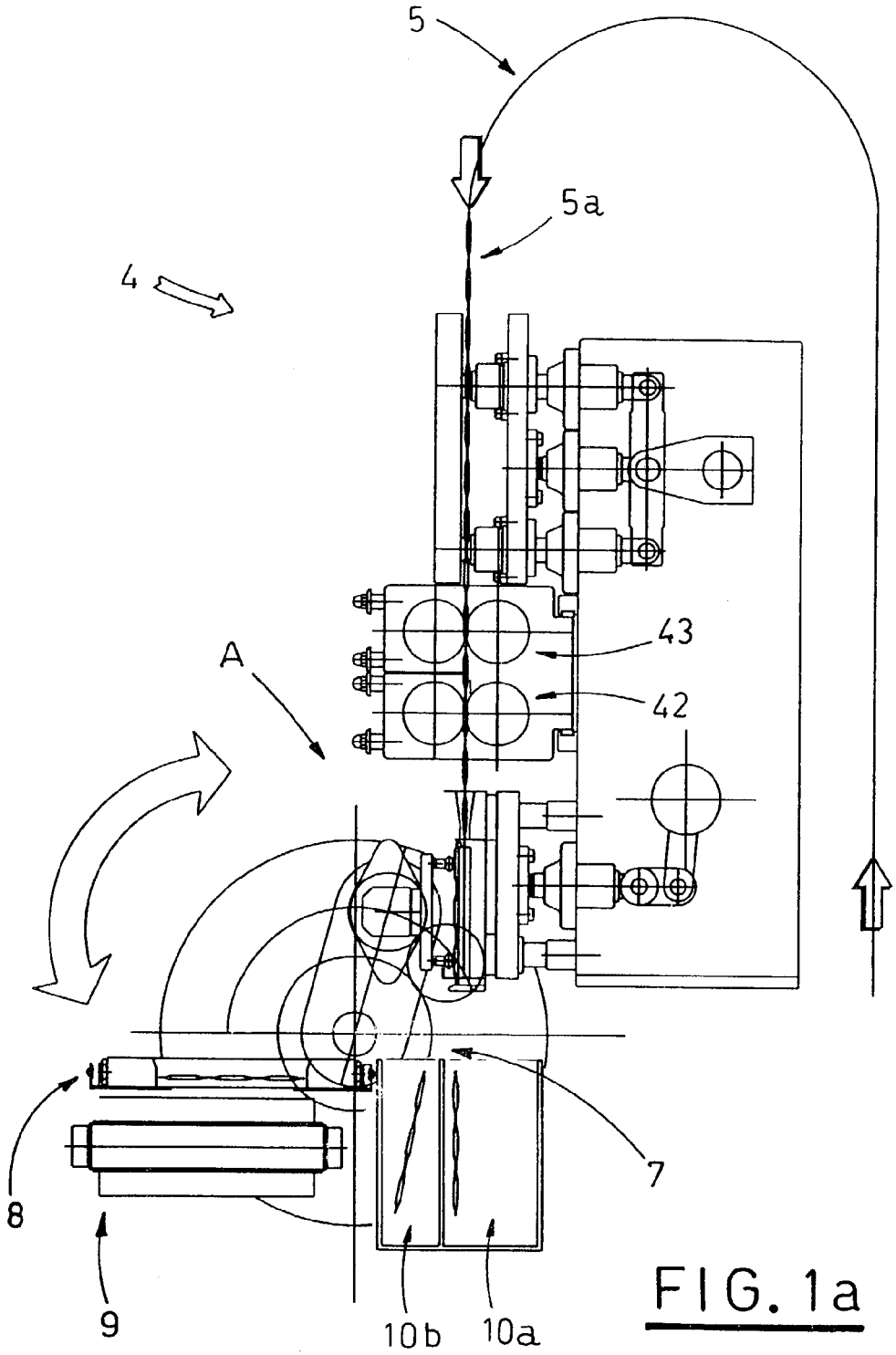
FIGS. 1*a*, 1*b* schematically show corresponding side and front views of a terminal operating station wherein defective strip packages are rejected according to the method of the invention in a particularly important operating step.

With reference to the above drawings, reference numeral 5 indicates a continuous band of heat-sealed pockets 5*a* evenly distributed and forming corresponding longitudinal and cross rows.

Figure 1B:
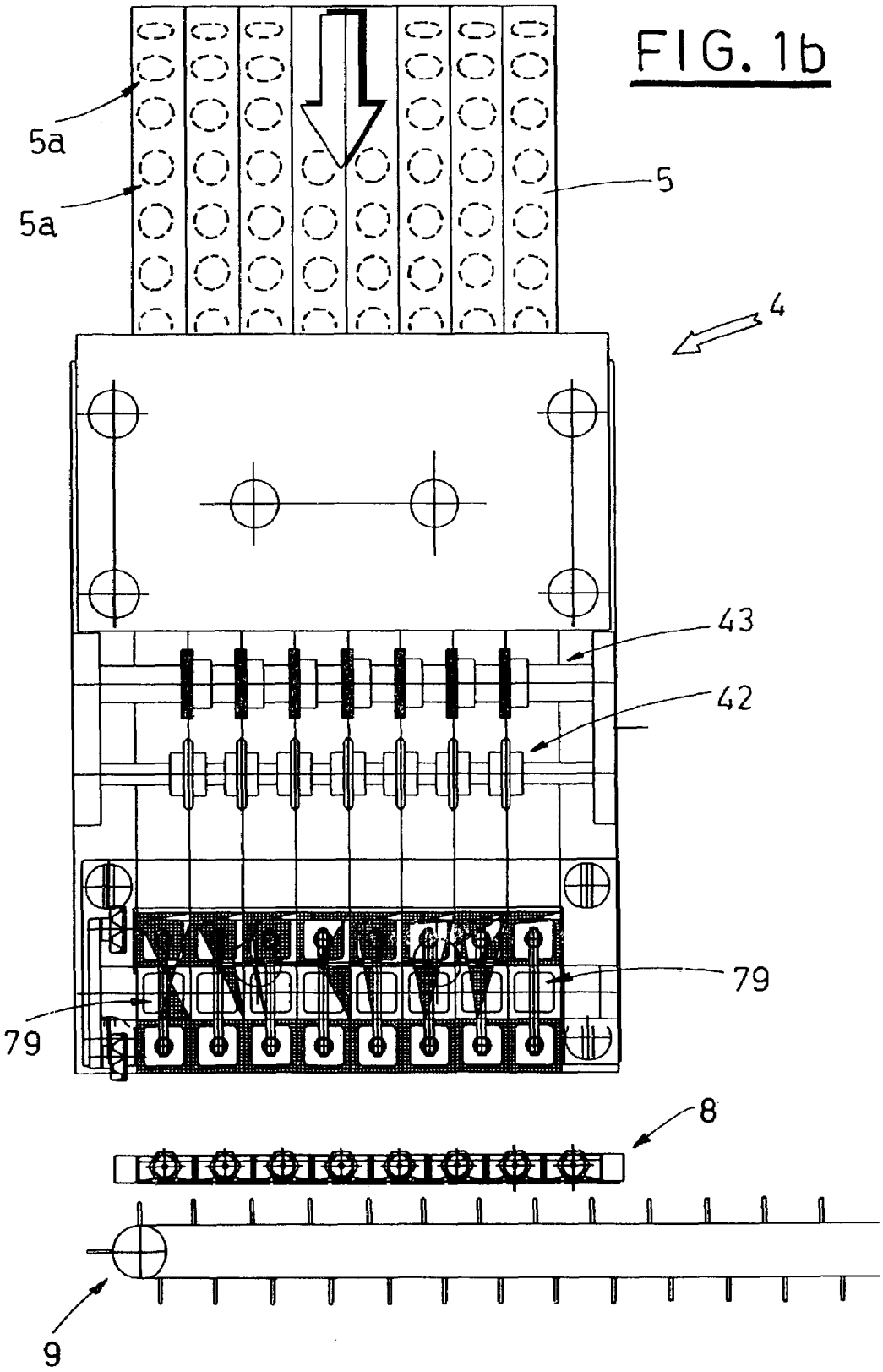

As it can be seen in FIG. 1*b*, the continuous band 5 is moved on a packaging line 4 by driving means 43.

The proposed method for rejecting defective items, in particular strip packages, during the transfer from a packaging line 4 to a conveying line, provides for the following operating steps:

- checking the integrity of the products contained in each heat-sealed pocket 5*a* belonging to a predetermined strip package by corresponding feeler means 40 associated to the packaging line 4;
- removable gripping of every tested strip package by transfer means 7 provided at the end of the packaging line 4 so as to determine a first pick-up configuration A;
- operating the transfer means 7 and moving the strip packages locked thereto away from the above packaging line 4;
- first release by the transfer means 7 of a first series of packages defective tested single strip (for example totally lacking the products inside each pocket defining the strip packages) at a first collection section 10*a*, provided in the proximity of the packaging line 4, in step relation with the motion of the same transfer means 7;
- second release by the transfer means 7 of a second series of defective tested single strip packages (for example due to the lack of one or more products, or due to the presence of damaged and/or broken products inside one or more pockets 5*a* defining the strip packages) at a second collection section 10*b*, provided in the proximity of the packaging line 4, for example adjacent to the first collection section 10*a*, in step relation with the motion of the same transfer means 7;
- positioning of every entire tested strip package onto the conveying line by the transfer means 7, at a second release configuration B.

Defective tested strip packages released by the transfer means 7 are advantageously conveyed by gravity towards the collection sections (10*a*, 10*b*).

In step relation with the check of the integrity of products contained in each heat-sealed pocket 5*a* belonging to a predetermined strip package, the following further steps are provided:

- printing and/or coding of data and/or information onto each heat-sealed pocket 5*a* by first and second means associated to the packaging line 4;
- cross pre-cutting of the continuous band 5 at portions comprised between adjacent cross rows by pre-breaking units associated to the packaging line 4;
- longitudinal cutting of the continuous band 5 at portions comprised between adjacent longitudinal rows by relative first cutting units 42 associated to the packaging line 4;
- cross cutting of the continuous band 5 at portions comprised between adjacent cross rows by relative second cutting units associated to the packaging line 4, so as to provide a plurality of strip packages with a predetermined longitudinal and cross format in output from the packaging line 4.

According to the same operation modes, it is possible to provide, after the second defective tested strip packages release step, a plurality of third release steps, performed by the transfer means 7 for rejecting further strip packages defective-tested at relative collection sections, provided in the proximity of the first collection section 10*a*, in phase relation with the motion of the same transfer means 7.

In this way, for example, it is possible to provide different collection sections, respectively second and third, for containing strip packages characterized by the lack of one or more products in one or more pockets 5*a* (second collection section) and by the presence of damages and/or broken products into one or more pockets 5*a* (third collection section).

The step in which each entire-tested strip package is positioned onto the conveying line by the transfer means 7 includes:

- a preliminary release of the strip packages by the transfer means 7 onto a stand-by line 8 positioned in proximity of the feeding line 4;
- a further release of such strip packages by the stand-by line 8 in a differentiated way and according to predetermined configurations onto underlying conveying means 9, substantially parallel to the stand-by line 8.

After having been released onto the conveying means 9, the strip packages are fed to a packaging machine according to a known way.

The transfer means 7 are equipped with a plurality of gripping means 79, situated beside each other and aligned, and synchronically operated by a common driving shaft 70, substantially parallel to the conveying line.

The gripping means 79 are moved, in step relation with the driving means 43 of the packaging line 4, from a pick-up position A, in which each gripping member picks-up a corresponding strip package in output from the same packaging line 4, in substantially vertical configurations, to a release position B, in which the gripping means release only the entire-tested strip packages onto the conveying line, in substantially horizontal configurations.

According to known methods, each gripping member 79 is supported by the driving shaft 70 which engages with corresponding idle wheels 79*b*, to make the latter counter-rotate one with respect to the other.

Figure 2:
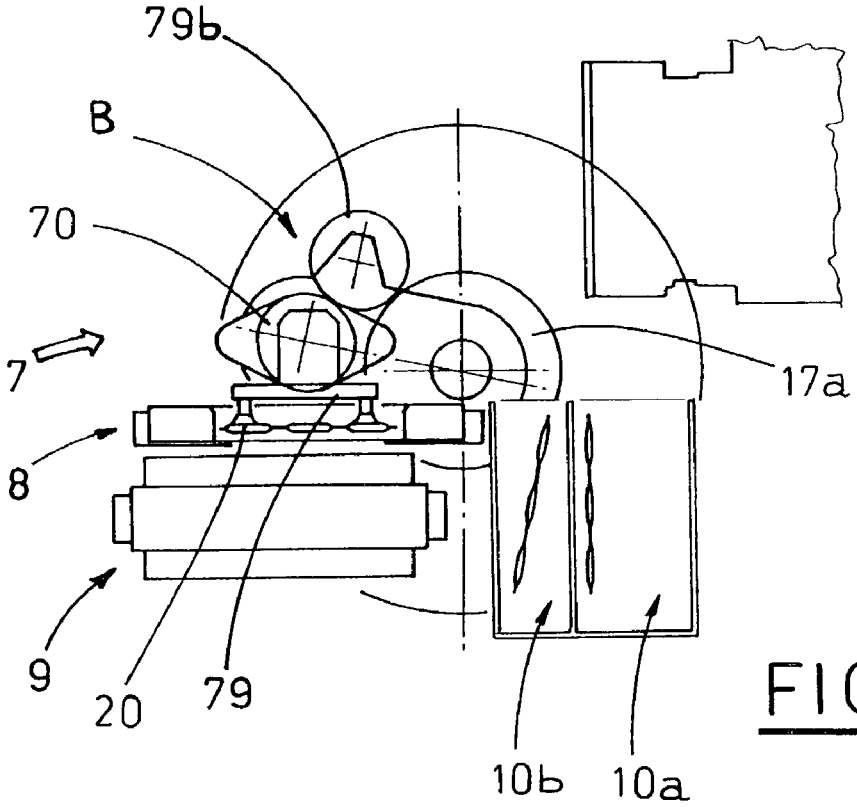
FIG. 2 schematically shows a side view of the operating station of FIG. 1 in a further operating step of the proposed method.
Figure 3:
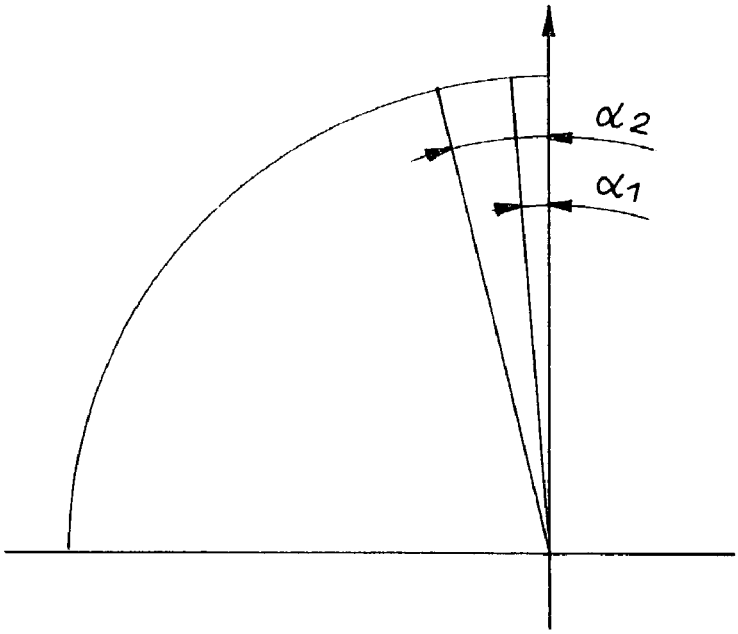
FIGS. 3, 4 schematically show two operation principle diagrams on which the rejection method of the invention is based.

The idle wheels 79*b*, in turn, engage with a fixed wheel 17*a*, following its path during the motion of the gripping means 79 from the pick-up position A to the release position B (FIG. 2).

The transfer means 7 are further equipped with relative control means associated to each gripping member 79, aimed at allowing the release, to the release position B, of the strip packages tested entire, which are regularly spaced apart by a predetermined value with respect to the pick-up position A.

Corresponding means 20 are associated to each gripping member 79 for removably gripping the strip packages.

The means 20 are aimed at being, individually and independently, set in communication with a vacuum source 80, so as to grip and/or release the strip packages in step relation with the motion of the driving shaft 70.

This allows each gripping member 79 to pick-up the relative strip package and release it at:

the stand-by line 8, if the package has been tested entire by the feeler means 40;

the first collection section 10*a*, after a rotation $\alpha_1$ of the driving shaft 70 with respect to the pick-up position A, if the strip package has been tested defective because, for example, it totally lacks the products in each pocket 5*a;* the second collection section 10*b*, after a rotation $\alpha_2$ of the driving shaft 70 with respect to the pick-up position A, if the strip package has been tested as defective because, for example, it lacks the products in one or more pockets 5*a*, that is because one or more pockets 5*a* contain damaged and/or broken products.

Figure 4:
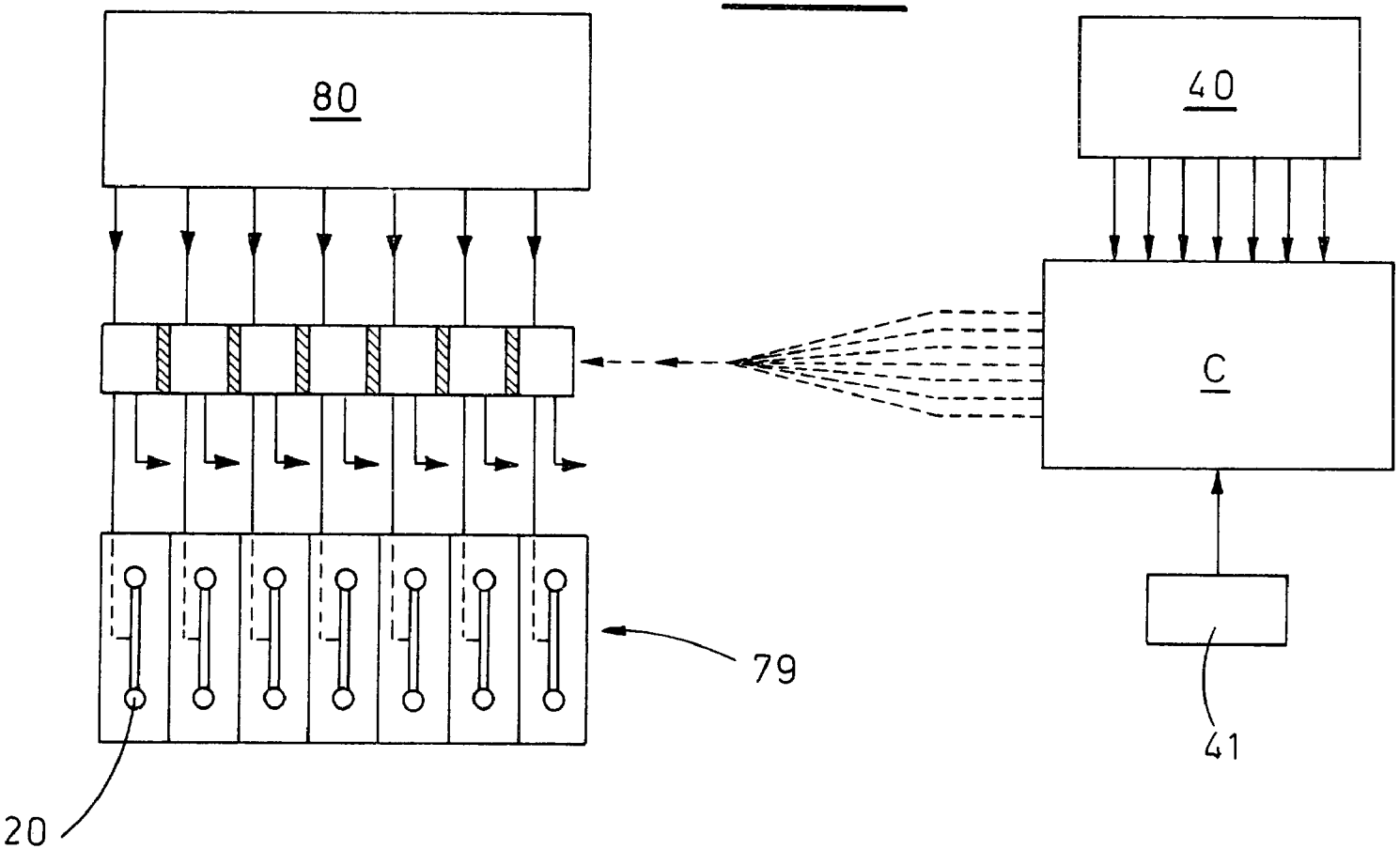

As shown in FIG. 4, according to a possible operating principle, a control unit C receives the signals from the feeler means 40 and in relation to the position signal coming, for example, from an encoder 41 associated to the pulling means 43 of the packaging line 4, is capable of suitably connecting and/or disconnecting each gripping member 79 from the vacuum source 80, thereby allowing the release of the corresponding strip package to the appropriate location (stand-by line 8, or first collection section 10*a*, or second collection section 10*b*).

The proposed method, described with reference to the particular case of rejection of strip packages wherein one or all pockets do not contain the product, or contain a broken and/or damaged product, can be applied to any method for rejecting defective items during the transfer from a generic packaging line to a generic conveying line.

In particular in the described case, the method allows the individual rejection of defective strip packages only, by suitably operating the single gripping element associated to the gripping means concerned.

This advantageously allows a differentiated rejection of the single strip packages into the relevant collection sections, in relation to the type of defect detected by the feeler means.

It is therefore possible, for example, to collect all strip packages containing all pockets without products in a predetermined section, thus facilitating and speeding up the rejection procedures to the advantage of costs.

The principle, on which the operating steps of the proposed method are based, allows an optimum application of the same steps in relation to the defective items whose size can vary within a wide range.

The proposed invention has been described, with reference to the enclosed figures, as a pure, not limiting example, therefore, it is understood that all possible variants can be applied to the invention without leaving its the protective scope defined by the following claims.

What is claimed is:

1. A method of removing single defective items from a plurality of non-defective items, during transferring from a packaging line to a conveying line, the items being moved on said packaging line by driving means, the method comprising:

checking the integrity of each item present on said packaging line and detecting defective items on said packaging line;

locating transfer means at an end of the packaging line and arranging the transfer means for removably gripping every checked item at a pick-up position thereof;

operating said transfer means for gripping every checked item and moving said gripped items in a continuous movement away from said pick-up position and to a final release position adjacent said conveying line;

while transferring the gripped items moving continuously from the pick-up position and prior to arriving at the final release position adjacent the conveying line, releasing the grip on each defective item for depositing the defective item into at least one first collection section, situated near said packaging line, in step relation with movement of the transfer means towards the conveyor line; and, positioning each non-defective item onto the conveying line when the transfer means reaches the final release position.

2. The method according to claim 1 further comprising, after releasing at least one defective item which is deposited in said first collection section, releasing a second defective item for deposit into a second collection section, situated near said first collection section, in step relation with the movement of said transfer means towards the conveying line.

3. The method according to claim 2 wherein said defective items released by said transfer means are conveyed by gravity to said collection sections.

4. The method according to claim 1 further comprising providing a plurality of defect item release positions for said transfer means for depositing defective items into one or more of a plurality of collection sections situated near said first collection section, each section being located in a position in step relation with the movement of said transfer means towards said conveying line.

5. The method according to claim 4, wherein said defective items, released by said transfer means at the plurality of release positions are conveyed, by gravity, to said collection sections.

6. The method according to claim 1 wherein said step of positioning each non-defective item onto said conveying line by said transfer means, includes:

a preliminary releasing, by said transfer means, of said items onto a stand-by line, situated near said packaging line;

a subsequent releasing of said items, by said stand-by line, in a differentiated way and according to predetermined configurations, onto underlying conveying means, substantially parallel to said stand-by line.

7. The method according to claim 6 further comprising feeding a packaging machine with the items released onto said underlying conveying means.

8. The method according to claim 1 wherein said transfer means include:

gripping means operated by at least one driving shaft and being substantially parallel to said conveying line, and moved in step relation with said packaging line, from a pick-up position, in which the gripping means pick-up checked items from the packaging line, to a final release position, in which the gripping means release the checked items onto the conveying line, control means associated with said gripping means for allowing the checked items to be released at the final release position and arranged to be regularly spaced apart by a predetermined distance with respect to the pick-up position.

9. The method according to claim 8 wherein said gripping means comprise suction elements associated to each gripping member for removably gripping said items, said suction elements being individually and independently set in communication with a vacuum source, so as to grip and/or release individual items in step relation with the rotation of said driving shaft.

10. The method according to claim 8 wherein said items re picked-up by said transfer means, from said packaging line, in substantially vertical configurations, and are released onto said conveying line in substantially horizontal configurations.

11. The method according to claim 1 wherein each item is contained in a corresponding heat-sealed pocket made in a continuous band formed by a predetermined number of longitudinal and cross rows of said pockets.

12. The method according to claim 11 further comprising, in step relation with the check of the integrity of each item contained in a corresponding heat-sealed pocket the following corresponding steps:

printing and/or coding of data and/or information onto each heat-sealed pocket by first and second means associated to said packaging line;

cross pre-cutting of said continuous band at portions comprised between adjacent cross rows by pre-breaking units associated to said packaging line;

longitudinal cutting of said continuous band at portions comprised between adjacent longitudinal rows by first cutting units associated to said packaging line;

cross cutting of said continuous band at portions comprised between adjacent cross rows by second cutting units associated to said packaging line, so as to provide a plurality of strip packages with a predetermined longitudinal and cross format in output from said packaging line.

* * * * *